US007232322B1

(12) United States Patent
Yen et al.

(10) Patent No.: US 7,232,322 B1
(45) Date of Patent: Jun. 19, 2007

(54) POWER ADAPTER WITH OPTIONAL TYPES OF REPLACEABLE PLUG

(75) Inventors: Lich-Chyum Yen, Taipei (TW); Chung-Yi Pai, Taipei (TW); Wen-Chi Huang, Taipei (TW)

(73) Assignee: Atech Technology Co., Ltd., Taipei (TW)

( * ) Notice: Subject to any disclaimer, the term of this patent is extended or adjusted under 35 U.S.C. 154(b) by 0 days.

(21) Appl. No.: 11/329,149

(22) Filed: Jan. 11, 2006

(51) Int. Cl.
*H01R 27/00* (2006.01)

(52) U.S. Cl. ..... 439/222; 439/170; 439/172; 439/372; 439/680

(58) Field of Classification Search ..... 439/222, 439/170, 172, 372, 680, 171, 518, 347, 173–175, 439/177, 217, 166, 218, 311–314, 131, 188
See application file for complete search history.

(56) References Cited

U.S. PATENT DOCUMENTS 5,613,863 A * 3/1997 Klaus et al. ..... 439/131
6,328,581 B1 * 12/2001 Lee et al. ..... 439/106
6,592,386 B2 * 7/2003 Teng et al. ..... 439/172
6,669,495 B2 * 12/2003 Philips et al. ..... 439/170

* cited by examiner

*Primary Examiner*—Truc T. Nguyen
*Assistant Examiner*—Edwin A. Leon
(74) *Attorney, Agent, or Firm*—Troxell Law Office, PLLC

(57) ABSTRACT

A power supply with optional types of plugs, composed by one universal body and replaceable plug, is disclosed. The universal body includes a plurality of blocks, a circular recess, an elastic switch key, and two conductive plates; whereas the plugs could be different specifications of plug with opposite blocks and two conductive plates, the block holes and blocks include a set of error-proof block hole and error-proof block which posses a block slot to hold the fan-shaped block.

5 Claims, 9 Drawing Sheets

POWER ADAPTER WITH OPTIONAL TYPES OF REPLACEABLE PLUG

BACKGROUND OF THE INVENTION

The present invention is related to a power adapter with optional types of replaceable plugs.

There are various kind of power adapter plugs, such as the American specification, European specification, English specification, and Australian specification, etc. As shown by FIGS. 1–4 the conventional power supply adapter with replaceable plugs in the current market is designed to have two parts: a universal body and various specification plugs, which are combined into a whole power adapter to allow the use of several replaceable plugs. Furthermore, conventional power adapter usually apply a slide rail or slide slot with a conductive plate to assemble different plugs with a universal body which often results in the lose of the connection part. Therefore, the connection of the prior art offers less solidity and safety, and needs further improvement.

SUMMARY OF THE INVENTION

It is therefore a primary object of the present invention to provide a power adapter with optional types of replaceable plugs which include top blocks around and two conductive plates within. The blocks are aligned with opposite block holes on the universal body and inserted into the circular recess before rotating to a preconfigured position. The fan-shaped block in front of elastic switch key of the universal body is inserted into the block slots of the plug to lock so that the plug can connect firmly with universal body to prevent the plug from coming loose. The elastic switch key is pushed backward to move the fan-shaped block from the rotary path of the blocks of the plug to take off replaced plug and change to another specification of plug.

It is another purpose of the present invention to provide a power adapter with replaceable plugs by arranging a set of error-proof blocks and error-proof block holes among plug blocks and block holes of the universal body by employing different blocks and block hole shapes or attaching an identification mark to distinguish the blocks and block holes for convenient assembly and error reducing.

DETAILED DESCRIPTION OF THE PREFERRED EMBODIMENT

Figure 1:
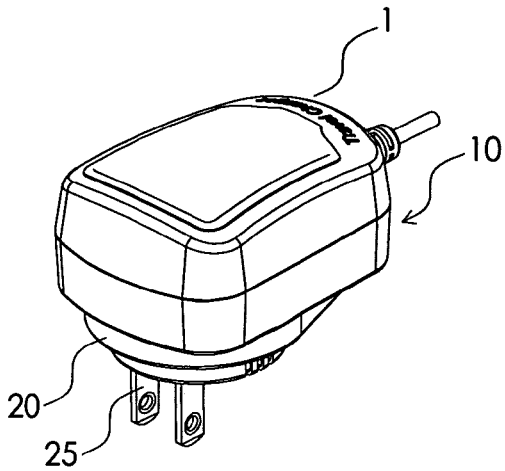
FIG. 1 is a perspective view of a plug according to the present invention illustrating the American specification.
Figure 2:
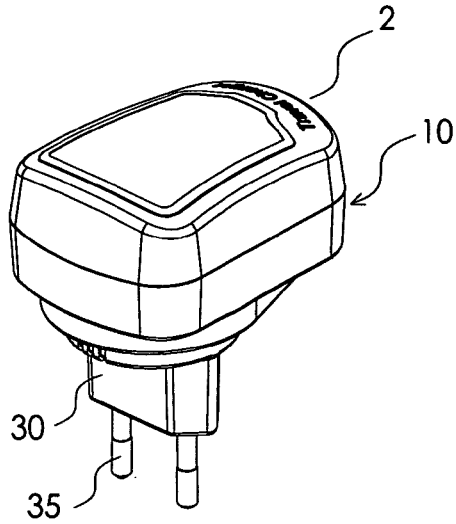
FIG. 2 is a perspective view of a plug according to the present invention illustrating the European specification.
Figure 3:
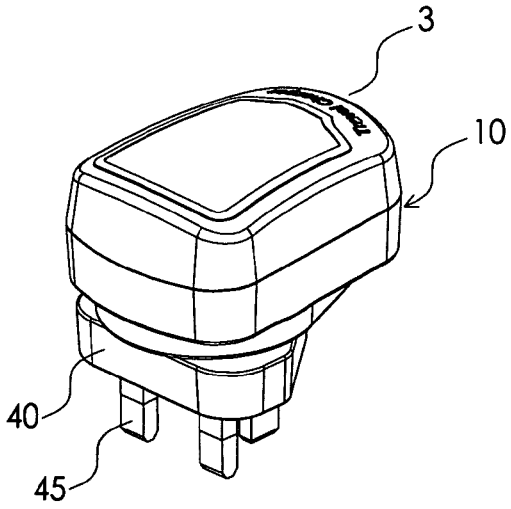
FIG. 3 is a perspective view of a plug according to the present invention illustrating the English specification.
Figure 4:
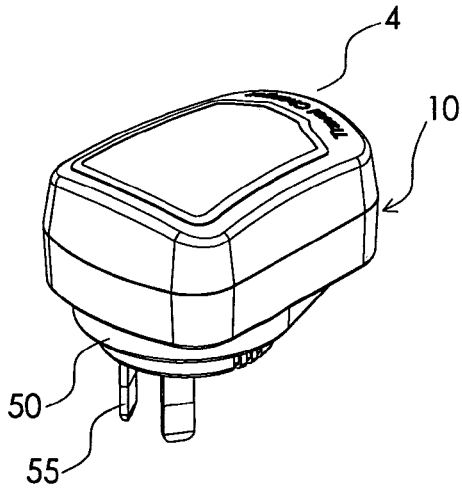
FIG. 4 is a perspective view of a plug according to the present invention illustrating the Australian specification.

FIG. 1–FIG. 4 show a power supply with different plug specifications 1, 2, 3, 4 which share a universal body 10 designed to accept different specifications of replaceable plugs: US, European, English, and Australia specification 20, 30, 40, 50, respectively, one of which is selected to combine with the universal body to form a whole power supply unit (1, 2, 3, or 4, respectively).

Figure 5:
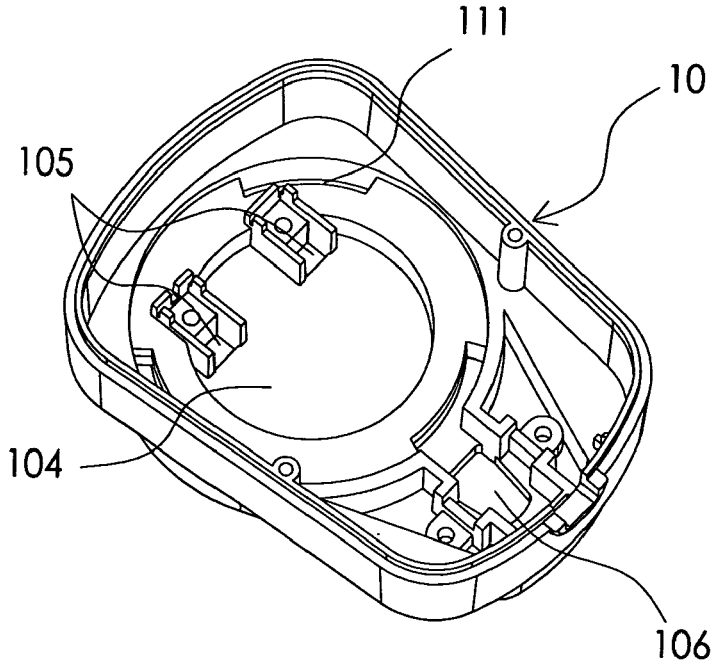
FIG. 5 is a perspective view of a lower part in accordance with the present invention.
Figure 6:
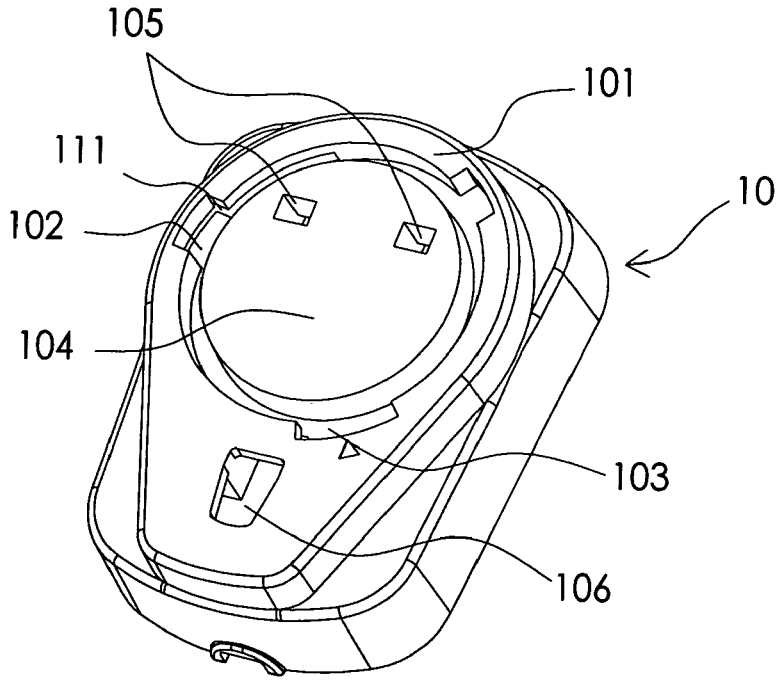
FIG. 6 is another view of the lower part in accordance with the present invention.
Figure 11:
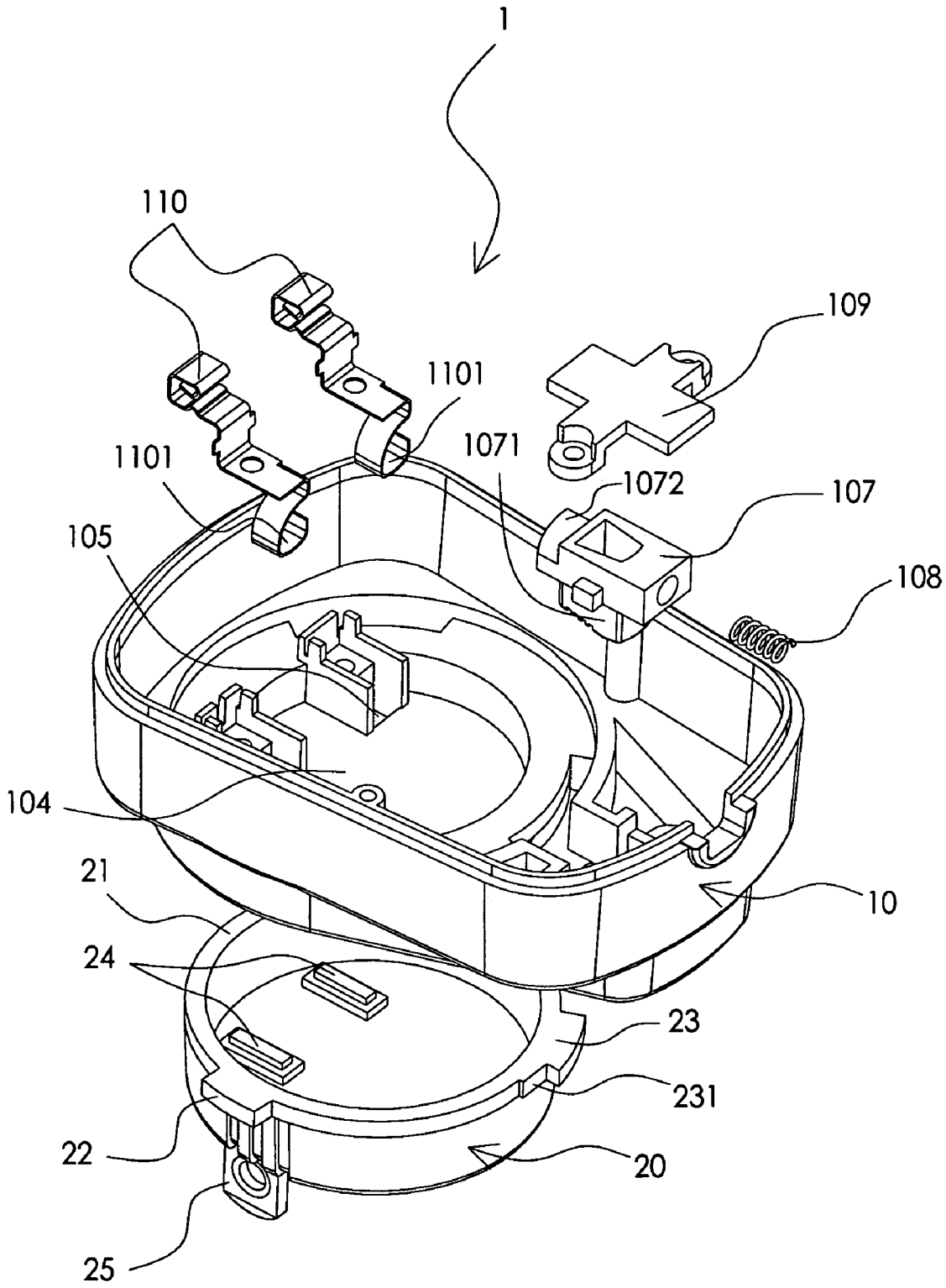
FIG. 11 is an explosive view of an embodiment with an American specification plug and a lower part in accordance with the present invention.
Figure 12:
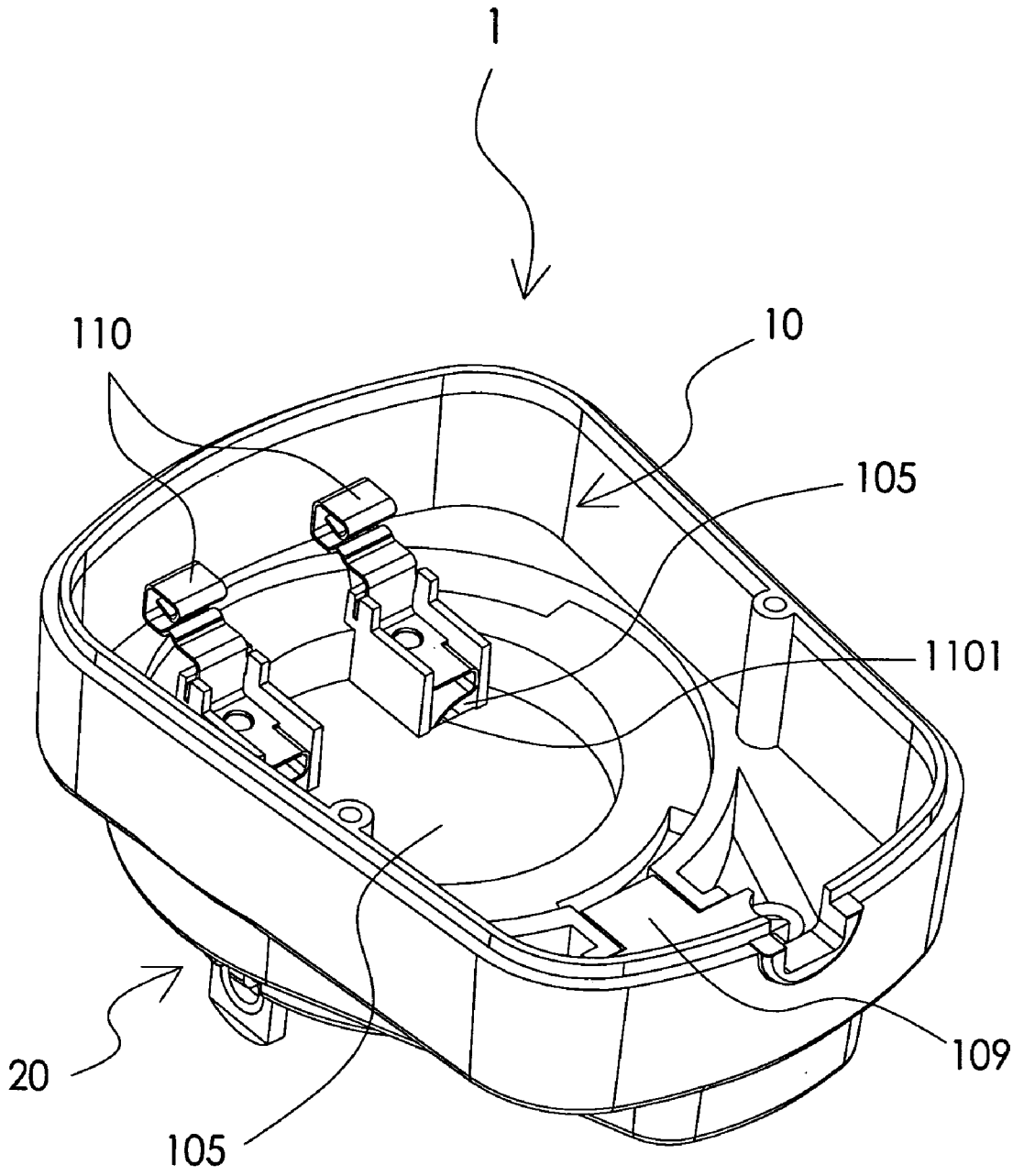
FIG. 12 is an assembling view of the embodiment in FIG. 11.

As shown in FIGS. 5, 6, 11, and 12, the universal body 10 is primarily formed from the combination of an upper part and a lower part with any outer shape. The bottom of the universal body 10 (lower part) includes a circular convex edge 101 with a plurality of connection slots 102 around the edge, including an error-proof slot 103 which is different from the other slots 102. The error-proof slot is preferably labeled with an "Δ" identification mark 112 for convenient and error-proof assembly. An inner surface 104 is within the circular edge 101 to form an inner circular slot 111 to act as the rotary path of the plug block hole. Furthermore, two symmetry openings 105 are fixed on the surface of inner surface 104 to accept the conductive surface end 1101 of the metal conductive plate 110 which is partially convex from the inner surface 104. The switch opening 106 is located at the back of the circular convex edge 10 to hold the control panel 1071 of the switch key 107 which is fixed at the outer edge of error-proof block hole 103 with fan-shaped block 1072 in front end and elastic piece 108 (such as a spring) fixed at the back end. Switch key 107 presses fan-shaped block 1072 by the force of elastic piece 108, locates at the rotary path of the error-proof block hole 23, 33, 43, 53 of replaceable plug 20, 30, 40, 50. Switch key 107 preferably protrudes from switch key opening 106 and can be pressed backward by pressing the control panel 1071 to make fan-shaped block 1072 move from the rotary path of error-proof block hole 23, 33, 43, 53. The switch key 107, fastened by a fixed plate 109 at the bottom cover, will move back when the pressure is released.

Figure 7:
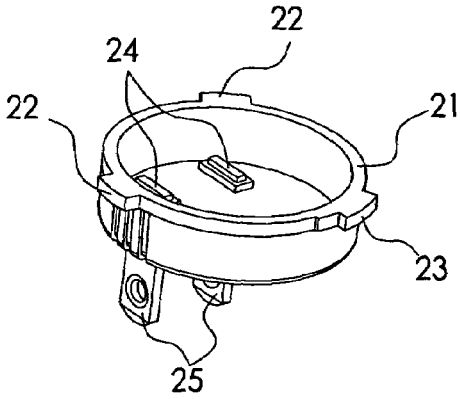
FIG. 7 is a perspective view of an embodiment with an American specification plug in accordance with the present invention.
Figure 7A:
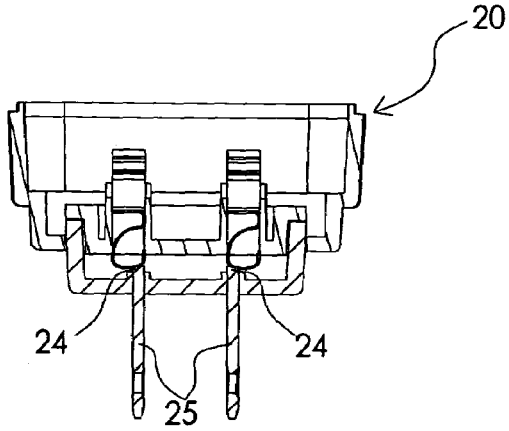
FIG. 7A is a lateral cross-sectional view an embodiment with an American specification plug in accordance with the present invention.
Figure 8:
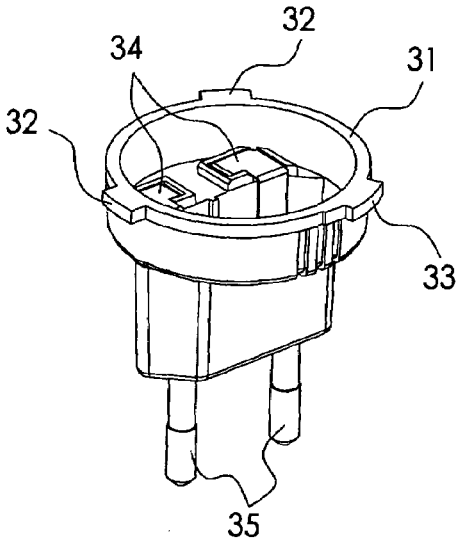
FIG. 8 is a perspective view of an embodiment with a European specification plug in accordance with the present invention.
Figure 8A:
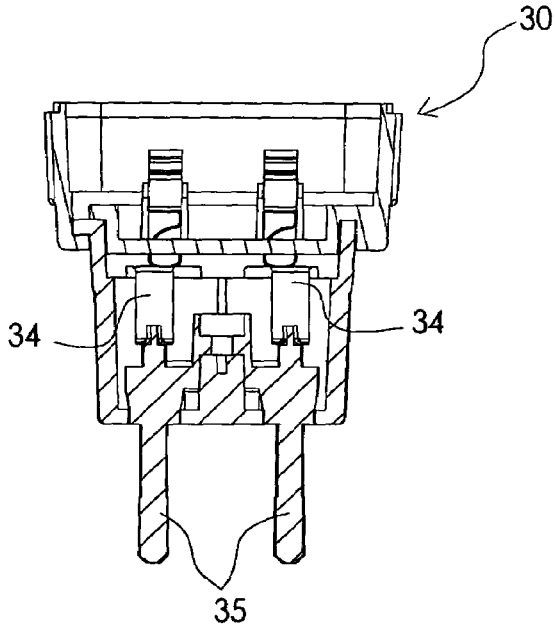
FIG. 8A is a lateral cross-sectional view an embodiment with a European specification plug in accordance with the present invention.
Figure 8B:
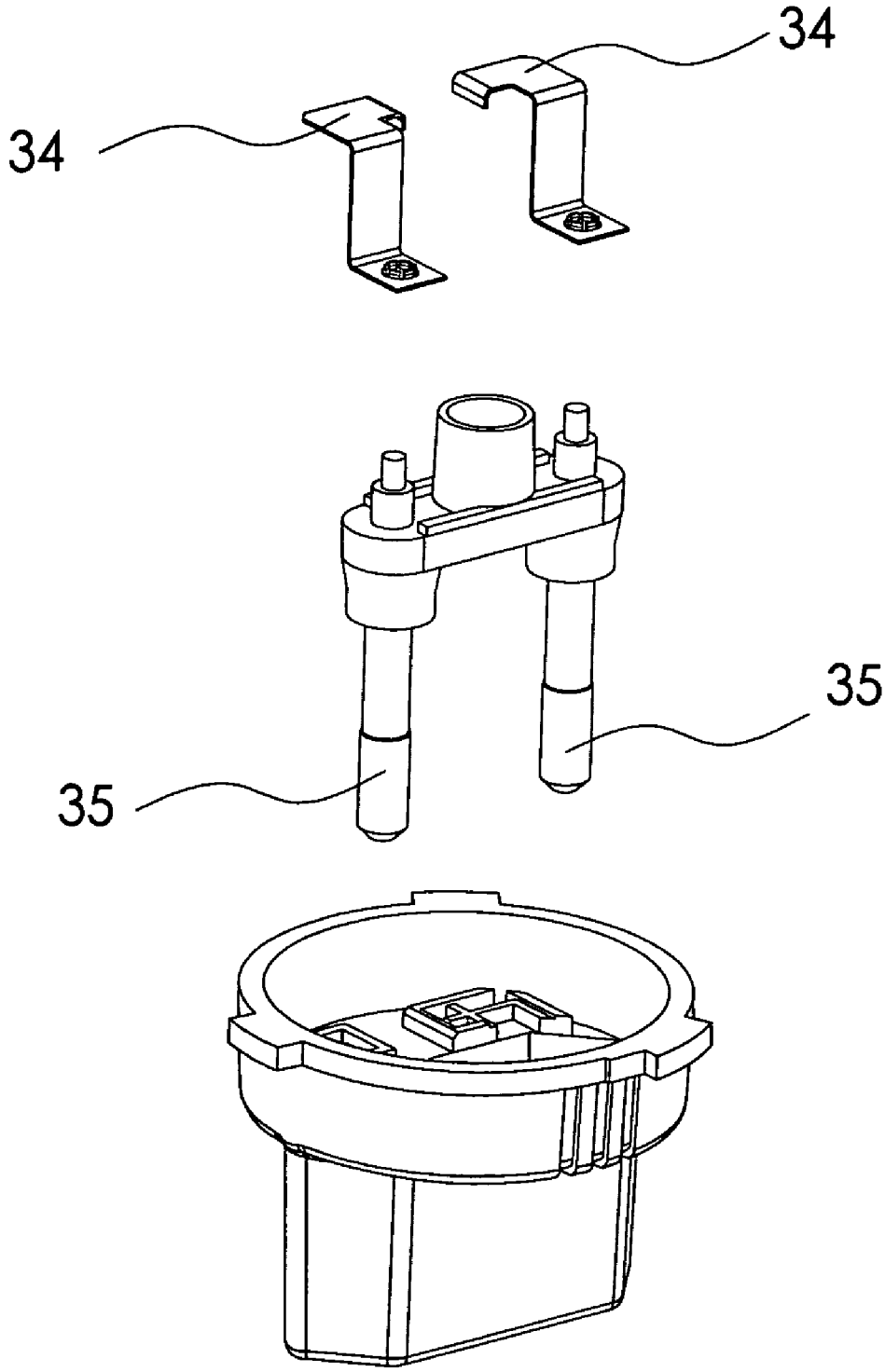
FIG. 8B is an explosive view of an embodiment with a European specification plug in accordance with the present invention.
Figure 9:
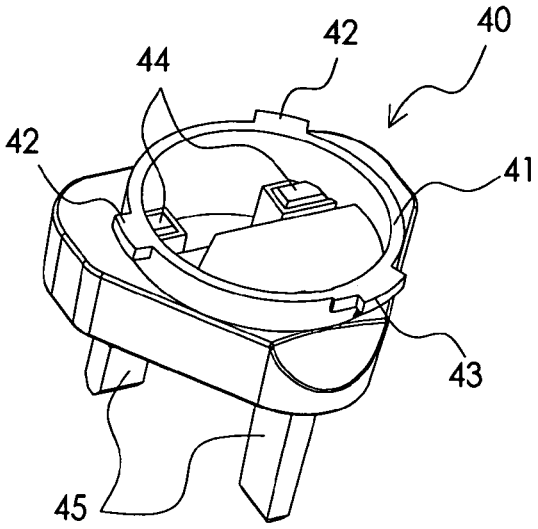
FIG. 9 is a perspective view of an embodiment with a English specification plug in accordance with the present invention.
Figure 9A:
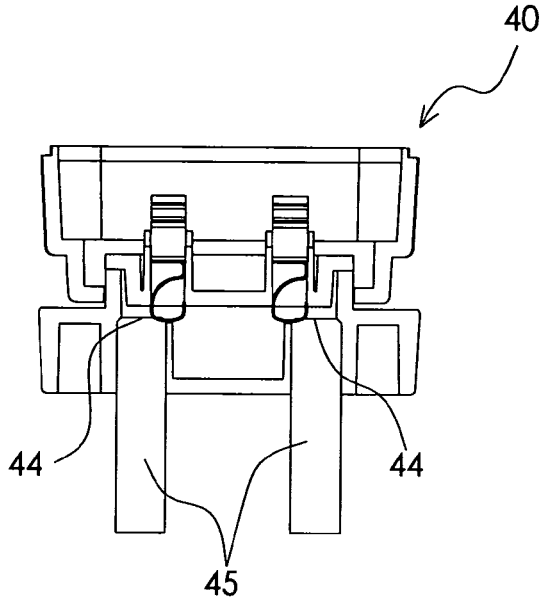
FIG. 9A is a lateral cross-sectional view of an embodiment with an English specification plug in accordance with the present invention.
Figure 10:
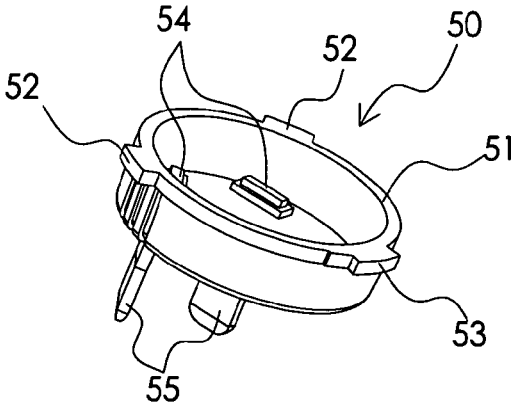
FIG. 10 is a perspective view of an embodiment with an Australian specification plug in accordance with the present invention.
Figure 10A:
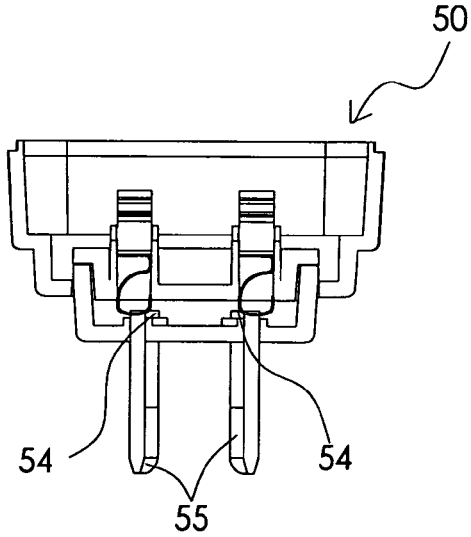
FIG. 10A is a lateral cross-sectional view of an embodiment with an Australian specification plug in accordance with the present invention.

With reference to FIGS. 7–12 at each top of the respective replaceable plug 20, 30, 40, 50 including a circular recess surface 21, 31, 41, 51 which includes block 22, 32, 42, 52 and error-proof block 23, 33, 43, 53 opposite to block hole 102 and error-proof block hole 103 of universal body. The shape of the error-proof block should preferably match with the error-proof hole and be different from the shape of other block to prevent a mistake, or put an attached identification mark "Δ" 26, 36, 46, 56 can be placed on the error-proof block for convenient assembly purposes (i.e., error reduction when assemble), and at each error-proof block 23, 33, 43, 53 including a slot 231, 331, 431, 531, and at the lower part of each circular recess surface 21, 31, 41, 51 set up two convex conductive plates 24, 34, 44, 54 opposite to the conductive surface end 1101 of the two symmetry openings 105 of inner surface 104 so that when replaceable plug 20, 30, 40, 50 is mounted and rotated to a fixed position, conductive plate 110 can connect with conductive surface end 1101. At the bottom of various specifications of plugs 20, 30, 40, 50 having different shapes of prongs 25, 35, 45, 55 pertaining to its specification which connect with conductive plates 24, 34, 44, 54 as per FIGS. 7A, 8A, 8B, 9A, and 10A. The prongs can be built in one solid unit, or two separate parts that connect into one unit.

Figure 13:
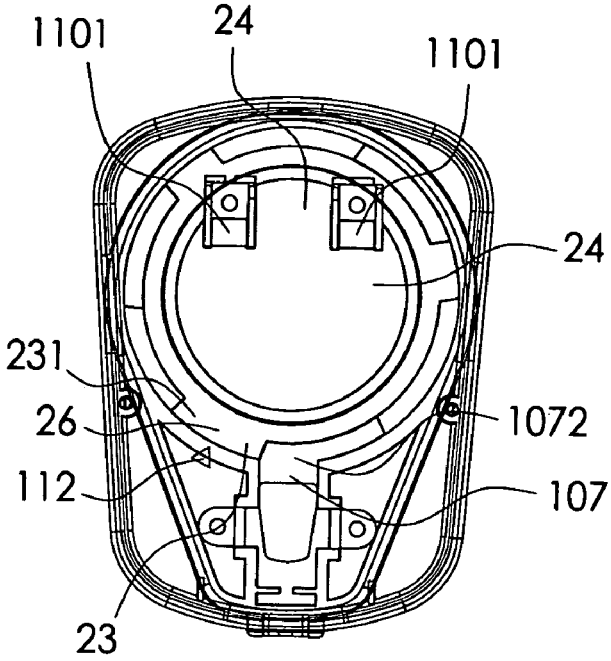
FIG. 13 is a first schematic drawing showing the assembling process of an embodiment in accordance with the present invention.
Figure 14:
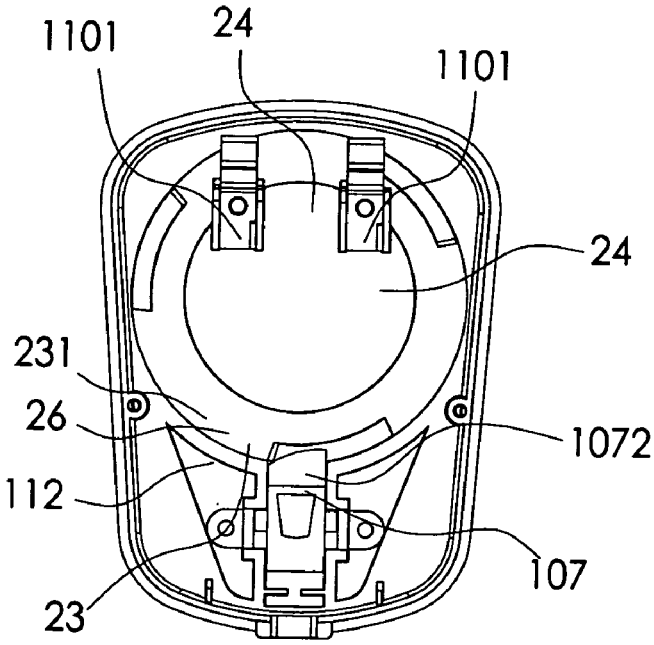
FIG. 14 is a second schematic drawing showing the assembling process of an embodiment in accordance with the present invention.
Figure 15:
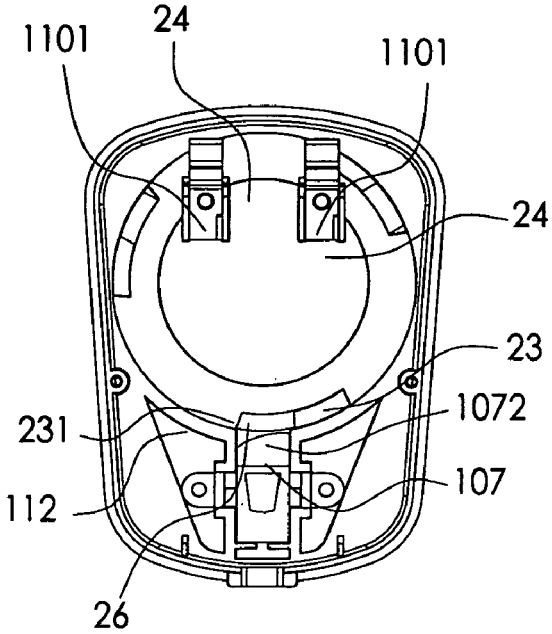
FIG. 15 is a third schematic drawing showing the assembling process of an embodiment in accordance with the present invention.
Figure 16:
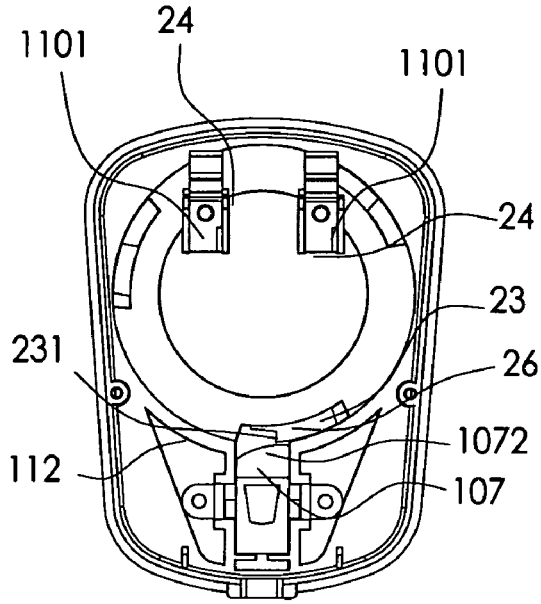
FIG. 16 is a fourth schematic drawing showing the assembling process of an embodiment in accordance with the present invention.
Figure 17:
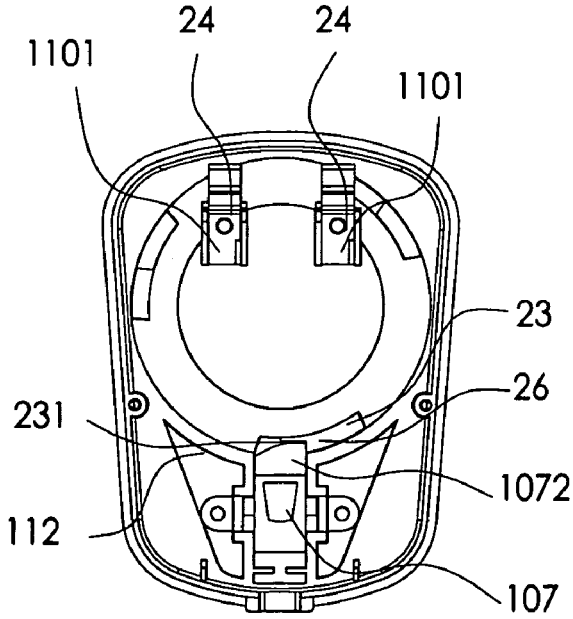
FIG. 17 is a fifth schematic drawing showing the assembling process of an embodiment in accordance with the present invention.

In the process of assembly, one of the plugs 20, 30, 40, 50 is selected, US specification plug 20 for example. As shown in FIGS. 11, 12 and 13~17, align mark "Δ" 26 on the plug with mark "Δ" 112 on the circular recess of the universal body. Then connect error-proof block 23 and blocks 22 of plug 20 with the opposite error-proof block hole 103 and block holes 102 of universal body 10 as per FIG. 13, while being careful to ensure that the blocks and error-proof blocks insert into the circular recess 111. Then, rotate the plug 20 as per FIGS. 14–16. As a result of the fan-shaped block 1072 in front of elastic switch key 107 convexing the rotary path of error-proof block 23 will be pressed back by the error-proof block 23 and will move to the block slot 231 of error-proof block 23 by the pressure of the elastic switch key 107 to prevent plug 20 from reverse movement and therefore lock firmly as per FIG. 17 when blocks 22, 23 of the plug rotate to the preconfigured position. At the same time, the two conductive plate 24 of the plug move to contact with the conductive surface end 1101 of the conductive plate of the universal body 10 to finish the process of assembly between the plug 20 and the universal body 10. When replaced with another type of plug, the elastic switch key is pressed backward by pushing the control panel surface 1071 to loosen the fan-shaped block from the rotary path of the blocks 22,23 of the replaced plug. The blocks and error-proof block of the plug 20 are reversed to move the opposite position of blocks' hole 102 and error-proof block hole 103 of the universal body 10 in order to remove the plug to mount another type of plug 30, 40, 50.

What is claimed is:

1. A power adapter with a replaceable plug comprising a universal body, and a replaceable plug which can be replaced by plugs with various specifications to assemble with the universal body, wherein the universal body, having a bottom surface with a circular convex edge surrounded by at least two block holes and a recess surface located at the inner lower part of the circular convex edge to form a recess slot between the recess surface and the circular convex edge, the universal body further comprising:

two symmetry openings at the inner surface to allow conductive surface ends of the universal body to convex out, wherein a switch opening holds a control panel of a switch key which is fixed at an outer edge of an error-proof block hole with a fan-shaped block at a front end of the switch key and an elastic piece fixed at a back end, wherein the replaceable plug of the switch key including a circular recess surface which has blocks opposite to block holes, and one of several blocks is arranged as a slot, wherein the circular recess surface has two convex conductive plates which are located opposite to the conductive surface ends of the two symmetry openings so that the conductive plates can connect with the conductive surface ends, wherein plug prongs located on a bottom of the plug are configured to connect with the conductive surface ends respectively, wherein, when the plug is rotated, the fan-shaped block is configured to move to the position of the block slot and spring into the block slot to thereby lock firmly to prevent the plug from reverse movement while simultaneously, the two conductive plates of the plug move to contact with the conductive surface ends of conductive plate of the universal body to transmit electricity.

2. The power adapter according to claim 1, wherein an identification mark is located at the block slot of the plug block.

3. The power adapter according to claim 1, wherein the block hole of the universal body, located opposite to the switch opening, is labeled with an identification mark.

4. The power adapter according to claim 1, wherein the prongs of the plug and the conductive plates are built as one solid unit.

5. The power adapter according to claim 1, wherein the prongs of the plug and the conductive plates are two separate parts which are connected into one unit.

* * * * *